US005887754A

United States Patent [19]

Wilkinson

[11] Patent Number: 5,887,754

[45] Date of Patent: Mar. 30, 1999

[54] TOOTHPASTE DISPENSER

[76] Inventor: William T. Wilkinson, P.O. Box 73, Salem, N.J. 08079

[21] Appl. No.: 947,397

[22] Filed: Oct. 8, 1997

[51] Int. Cl.[6] ..... B67D 05/00

[52] U.S. Cl. ..... 222/78

[58] Field of Search ..... 222/78, 586; D9/307, D9/310, 314, 338, 563; D04/107, 124, 136

[56] References Cited

U.S. PATENT DOCUMENTS

| | | | |
|---|---|---|---|
| D. 24,468 | 7/1895 | Gault | D9/314 |
| D. 296,419 | 6/1988 | Terrell | D9/302 |
| D. 304,791 | 11/1989 | Devigili | D6/542 |
| D. 346,551 | 5/1994 | Terrell | D9/314 |
| D. 369,969 | 5/1996 | Grivory | D9/314 |
| 5,547,107 | 8/1996 | Boiardi | 222/1 |

*Primary Examiner*—Andres Kashnikow
*Assistant Examiner*—David Deal
*Attorney, Agent, or Firm*—Connolly & Hutz

[57] ABSTRACT

A toothpaste dispenser is in the form of a hollow container having a chamber with toothpaste therein. A dispensing spout communicates with the chamber and includes a cap detachably mounted over the dispensing spout for selectively closing the spout. The container includes externally mounted structure simulating a portion of the human mouth anatomy to function as an indicator for making readily apparent to the user that the dispenser is for the dispensing of toothpaste and to encourage its use particularly by children. The simulated anatomy could be a tooth such as a molar or could be lips or a tongue.

16 Claims, 3 Drawing Sheets

TOOTHPASTE DISPENSER

BACKGROUND OF THE INVENTION

An important part of dental hygiene is in the use of a regular program of brushing the teeth. This is particularly important with young children who sometimes find tooth brushing to be a chore. In order to teach a child to adopt tooth brushing habits it would be desirable if brushing the teeth became more pleasant.

SUMMARY OF THE INVENTION

An object of this invention is to provide a toothpaste dispenser which has appeal to the users, particularly children, to help in the training of good dental hygiene.

A further object of this invention is to provide such a toothpaste dispenser which incorporates structure to readily indicate to the user that the dispenser is for dispensing toothpaste.

In accordance with this invention a toothpaste dispenser, which could otherwise be of any of the known forms conventionally available, also incorporates externally mounted structure which simulates a portion of the human mouth anatomy. As a result the user, particularly children, view the structure as an indicator to make it readily apparent that the dispenser is for the dispensing of toothpaste. The incorporation of the structure also provides ornamental appeal to the user. Additionally, the structure could function as a manner of identifying a particular product from a specific manufacturer so as to distinguish it from competing products. After is has functioned as a dispenser, it could be used as a toy or a collectable.

The portion of the human mouth anatomy may take various forms, such as teeth, lips or the tongue. In a preferred practice of the invention the portion of the human mouth anatomy is a tooth and preferably a molar. The portion of the human mouth anatomy could be located at any suitable part of the dispenser such as at the top, on the bottom or on the spout as a protective cap or closure. The invention may be practiced where the structure simulating a portion of the human mouth anatomy is in two parts such as two lips or upper and lower teeth which come closer together during use of the dispenser.

THE DRAWINGS

DETAILED DESCRIPTION

Figure 4:
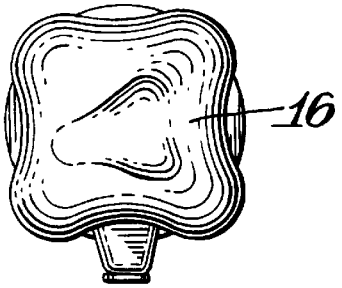
FIGS. 4–5 are top and bottom plan views of the dispenser shown in FIGS. 1–3.
Figure 1:
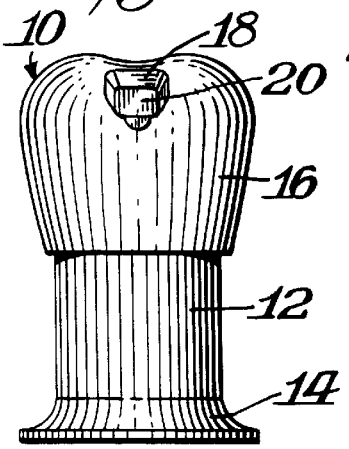
FIG. 1 is a front elevational view of a toothpaste dispenser which includes a molar shaped tooth at the top of the dispenser in accordance with this invention.
Figure 2:
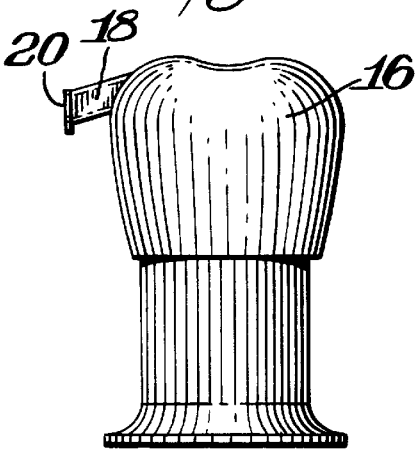
FIG. 2 is a right side elevational view of the dispenser shown in FIG. 1 with the left side elevational view being a mirror image thereof.
Figure 3:
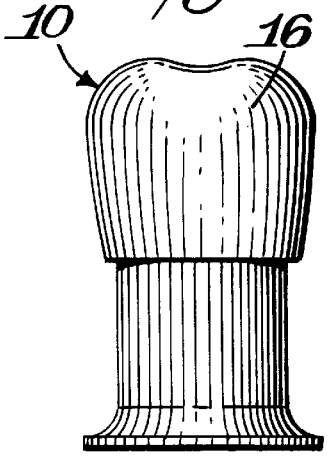
FIG. 3 is a rear elevational view of the dispenser shown in FIGS. 1–2.
Figure 5:
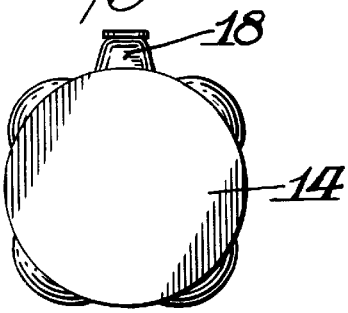
Figure 9:
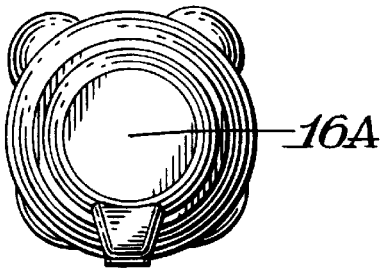
FIGS. 9–10 are top and bottom plan views of the dispenser shown in FIGS. 6–8.
Figure 6:
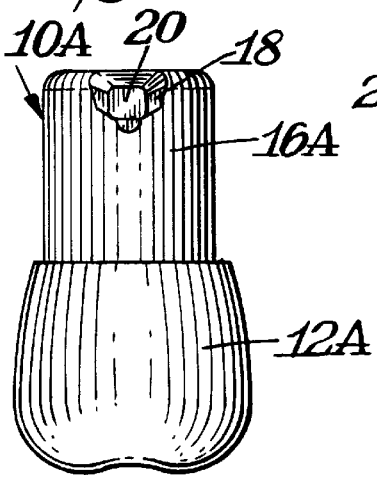
FIG. 6 is a front elevational view of a toothpaste dispenser incorporating a molar shape on the bottom portion thereof.
Figure 7:
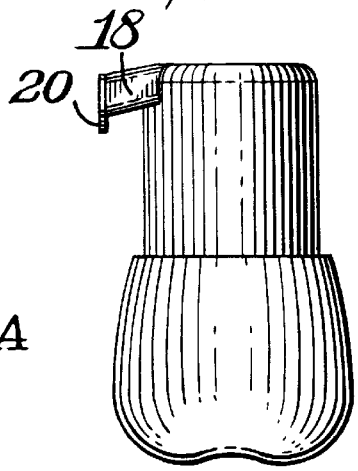
FIG. 7 is a right elevational view of the dispenser shown in FIG. 6 with the left side being a mirror image thereof.
Figure 8:
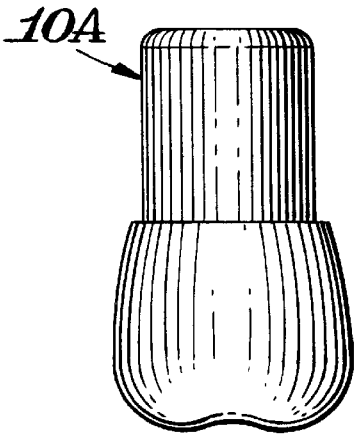
FIG. 8 is a rear elevational view of the dispenser shown in FIGS. 6–7.
Figure 10:
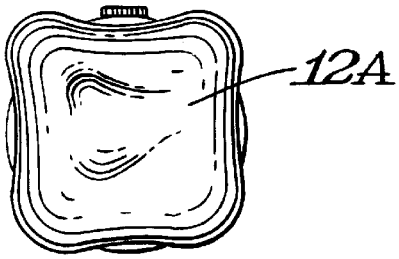

The present invention utilizes one or more mouth parts or portions of the human mouth anatomy as part of a toothpaste dispenser. This not only provides ornamental appeal, but also functions to help attract users, particularly children, and serves as indicating structure to make readily apparent to the user that the dispenser is for the dispensing of toothpaste. By making the toothpaste dispenser more appealing it is easier to train children in adopting good dental hygiene. The invention also provides a manner of utilization as a marketing force by reinforcing the product identity so that a specific manufacturer could adopt one or more forms of the invention as a means of product identity to distinguish that product from those of competitors.

The simulated mouth structure could be used with any toothpaste dispenser, such as tubes, cans or pumps. In the preferred practice of the invention the dispenser is a pump because it includes rigid structure so that it can be mounted in an upright position thereby prominently displaying the externally mounted simulated structure.

The simulated structure could be used on one or more parts of the dispenser such as the top, the bottom, on the spout as a closure or on a refill cartridge. In a preferred practice of the invention the simulated structure is the top of the dispenser.

The simulated structure could be any suitable portions of the human mouth anatomy, such as lips, gums, the tongue or teeth. Such portions of the mouth anatomy are of known shape and appearance as is readily visible in medical/dental texts. As later described were used as the teeth, the simulated structure could be a whole set or a plurality of teeth. Preferably, however, the structure is a single tooth and most preferably a molar. A molar is the most desired form of tooth in the practice of this invention because its shape is easily recognizable as a tooth. Additionally, unlike, for example, incisors, or other teeth, the molar has large dimensions for both its width and length thereby being more readily being adaptable as being a dispenser of generally equal length and width.

Where the dispenser is in pump form the dispenser could be a single or a multi-chamber pump of any suitable shape and/or design. The pump could have any number of parts, but preferably is of two basic parts, a top and a bottom which are telescopically arranged with respect to each other. Such pump would include the normal structures such as a plunger or piston head with a sliding seal and would include a dispensing spout. An example of a suitable multi-chamber pump is commercially marketed under the MENTADENT brand name.

Where a pump type dispenser is used, the top could slide around the outside of the bottom or could slide inside the bottom. The toothpaste could be located in the top or in the bottom. The toothpaste could be in a replaceable cartridge which could be disposed of after the toothpaste has been fully dispensed and a new cartridge inserted into the reusable other component. This lends itself to the possibility of incorporating the simulated structure on the reusable part so that the same structure could be reused. Alternatively, the simulated structure could be on the cartridge to provide the possibility of a variety of different forms of simulated structure with each new cartridge.

As noted, the invention could be practiced with generally any known type of toothpaste dispenser, whether the dispenser be in the form of a toothpaste tube, a can or a pump. Because the details of such a dispenser, including their internal mechanisms are known, it is not necessary for an understanding of the present invention to repeat those details herein. Reference, however, is made to my U.S. Pat. Nos. 4,742,940, 4,858,785, 5,092,496 and also to U.S. Pat. No. 5,547,107 which describes various type of pump dispensers including dispensers using replaceable cartridges. The details of the above noted patents are incorporated herein by reference thereto. Additionally, reference is made to my U.S. design Pat. No. DES. 296,060 which relates to a toothpaste dispenser having a "happy face" depicted on its top surface. The present invention differs from that design in that, for example, the simulated structure of the present invention simulates a portion of the human mouth anatomy rather than an entire face and as noted the portion relates to the mouth thus being more indicative of tooth brushing usage.

FIGS. 1–5 illustrate one form of the dispenser 10 in accordance with this invention. As shown therein dispenser 10 is of the pump type which includes a rigid bottom member 12 terminating in a flared base 14. Bottom member 12 is telescopically received in rigid upper member 16. For this purpose member 16 could include an inner tubular wall shaped and dimensioned to closely receive bottom member 12. Member 12 could have the piston head and member 16 could have the toothpaste containing chamber. Alternatively, member 12 could be hollow and have a chamber for containing the toothpaste and member 16 could have the piston head forcing the toothpaste through a passage in the member 16. Thus one of the members would preferably have a piston head terminating in a sealing lip to slidably contact the inner surface of the toothpaste chamber so that during the inward telescopic movement of member 12 into member 16 the toothpaste containing chamber becomes smaller and toothpaste is forced out of the hollow container through dispensing spout 18. Dispensing spout 18 preferably includes a cap, lid or other sanitary closure 20 which is selectively openable to permit the toothpaste to be dispensed from spout 18. In accordance with this invention upper member 16 is in the form of a molar. Thus, the user readily recognizes the dispenser as being one that would dispense toothpaste by virtue of the externally mounted structure which simulates a molar.

FIGS. 6–10 illustrate a variation of the invention wherein the dispenser 10A has a rigid upper member 16A, preferably of cylindrical shape. The rigid lower member 12A is formed as a molar. Thus, as in the embodiment of FIGS. 1–5 wherein the dispenser includes rigid upper and bottom members, the telescopic action forces the toothpaste through the dispensing spout 18 upon closure 20 being selectively removed away from the spout 18 to permit discharge of the toothpaste.

Figure 11:
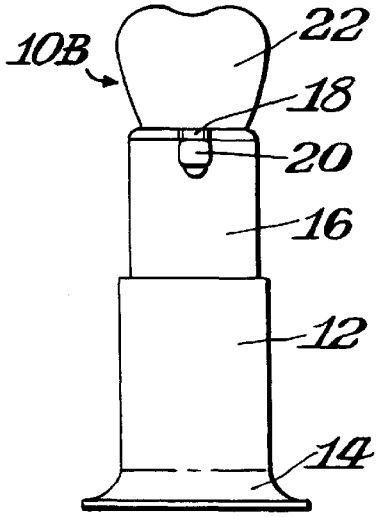
FIG. 11 is a front elevational view of yet another form of dispenser wherein a molar is mounted at the top of a dispenser in accordance with another embodiment of this invention.

FIG. 11 shows a variation wherein the dispenser 10B has a rigid cylindrical outer base member 12 with a flared bottom 14. A rigid upper member 16 is telescoped into bottom member 12. The dispenser 12B also includes a spout 18 with a removable cover 20. In accordance with this invention the dispenser 12B has a simulated molar 22 mounted at the top of and distinct from upper member 16. An alternative would be to locate the molar at the bottom below member 12 instead of or in addition to upper molar 22.

Figure 12:
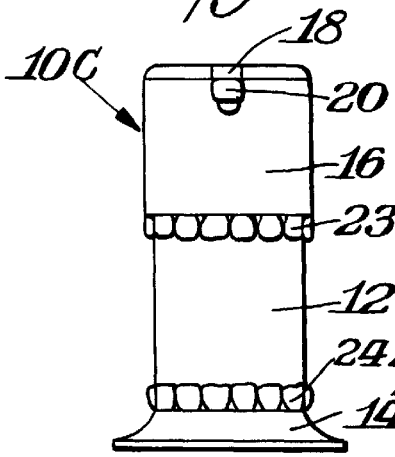
FIG. 12 is a front elevational view of yet another embodiment of this invention which incorporates a plurality of simulated upper and lower teeth spaced from each other in its original condition.
Figure 13:
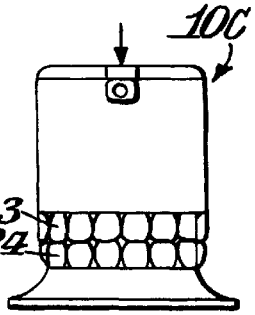
FIG. 13 is a view similar to FIG. 12 showing the dispenser when the toothpaste has been completely dispensed.

FIGS. 12–13 illustrate another form of dispenser 12C in accordance with this invention. As shown therein there is a bottom 12 having a flared base 14 with a telescopic upper member 16 mounted for movement over and around bottom 12. This illustrates that the invention can be practiced where the bottom member is of smaller diameter than the upper member as shown in FIG. 12 or where the bottom member is of larger diameter as shown in FIG. 11. Dispenser 12C also includes a spout 18 with a removable closure 20. In accordance with this invention the simulated structure is in the form of a set of aligned upper teeth 23 around or at the lower edge of upper member 16 and a set of aligned lower teeth 24 at or around the lower portion of bottom member 12. During use of the dispenser 10C the set of teeth 23 and the set of teeth 24 would be gradually moved toward each other. When the toothpaste has been fully dispensed the sets of teeth 23,24 contact each other as shown in FIG. 13 thereby simulating a closed mouth. This embodiment thus has the added advantage of giving an indication to the user of the amount of toothpaste left in the dispenser during intermediate stages of dispensing.

Figure 14:
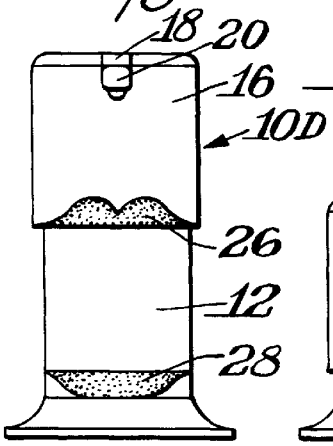
FIG. 14 is a view similar to FIG. 12 of yet another embodiment of this invention wherein the simulated structure is a pair of lips.
Figure 15:
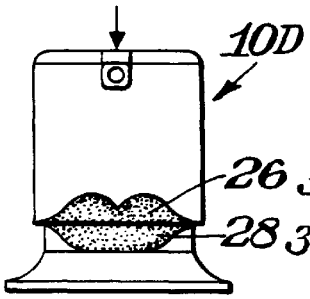
FIG. 15 is a view similar to FIG. 13 of the dispenser shown in FIG. 14.

FIGS. 14–15 show a dispenser 10D which operates in a similar manner to dispenser 10C. In this embodiment, however, the simulated structure is an upper lip 26 on upper member 16 and a lower lip 28 on bottom member 12. When the toothpaste has been completely dispensed the lips come together as shown in FIG. 15.

Figure 16:
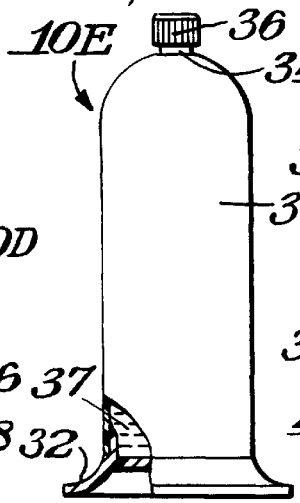
FIG. 16 is a front elevational view of yet another form of dispenser shown in accordance with this invention wherein the simulated structure is a tongue.

FIG. 16 shows a variation of the invention for a dispenser 10E. As shown therein the main body of the dispenser 30 flexible or semi-flexible or semi-rigid tube on the form of a simulated tongue which is made of such squeezable material. Main body or tongue 30 is mounted in any suitable manner on a rigid base 32. A dispensing spout 34 is located at the upper end of tongue or main body 30 removably covered by cap 36. In use cap 36 would be removed. The user would then squeeze tongue 30 to force the toothpaste 37 out of spout 34.

Figure 17:
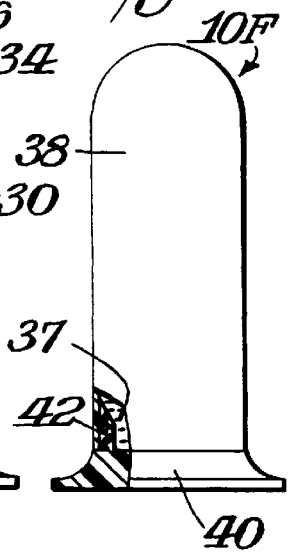
FIG. 17 is a front elevational view of yet another form of this invention also showing the simulated structure in the form of a tongue.

FIG. 17 shows a variation of the dispenser illustrated in FIG. 16. In FIG. 17 the dispenser 10F also includes a flexible tongue 38. Tongue 38 is releaseably engaged to the base 40 in any suitable manner such as by a threaded connection 42. In use base 40 acts as a removable closure or cap which would be unscrewed from tongue 38 to expose the open bottom of tongue 38. The open bottom thus acts as the dispensing spout which may be open completely across the lower end of tongue 38 or only in a limited area so that upon squeezing of tongue 38 the toothpaste 37 would be dispensed.

In the embodiments of FIGS. 16 and 17 where, for example, a semi-rigid squeeze type tube is used to simulate the flexible tongue, the tongue is mounted on a rigid base 32 or cap 40 so that the device 10E or 10F would stand upright. It is to be understood that the concept of using a tongue as the simulated portion of the human mouth anatomy may also be accomplished with a rigid pump type container similar to the previously described embodiments 10A–10D.

Figure 18:
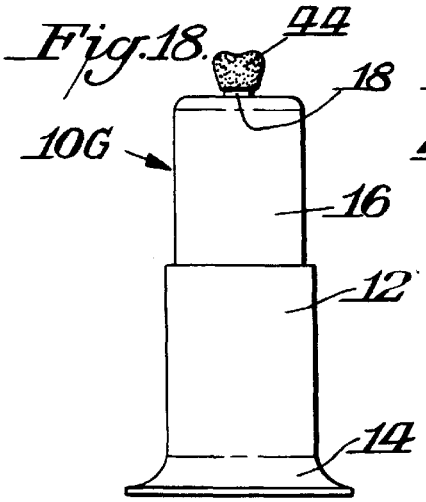
FIG. 18 is a front elevational view of still yet another dispenser in accordance with this invention wherein the simulated structure is a molar mounted as a cap on a top spout.
Figure 19:
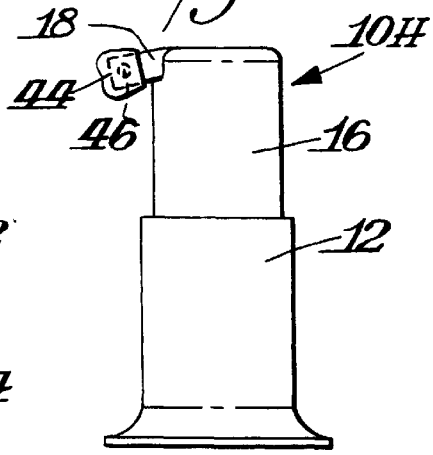
FIG. 19 is a view similar to FIG. 18 of yet another form of this invention wherein the simulated structure is a molar mounted as a cap on a side spout.

FIGS. 18–19 show other variations of utilizing externally mounted structure simulating a portion of the human mouth anatomy for a toothpaste dispenser. As shown in FIG. 18 a pump type dispenser 10G is illustrated having an inner telescopically mounted upper member 16 which is received in lower member 12 having a flared base 14. A dispensing spout 18 is located at the top of the dispenser 10G. In accordance with this invention the closure 44 for spout 18 is in the form of the simulated portion of the human mouth anatomy. As illustrated the closure 44 is a molar.

FIG. 19 shows a dispenser 10H which operates and is structured in generally the same manner as dispenser 10G of FIG. 18. The difference in FIG. 19 is that the dispensing spout 18 is a side spout and the closure 44 is thus located on the side rather than the top of the dispenser. In the embodiment shown in FIG. 19, as in the embodiment of FIG. 18, the cap 44 may be mounted to the spout by any suitable means such as by a ball and socket arrangement 46.

It is to be understood that various features shown in individual embodiments of the invention may be used in other embodiments. Thus, for example, the components of the pump may include each of the upper and lower members incorporating simulated molar structure. Combinations of simulated structure could include using both the tongue and/or lips and/or teeth for the same dispenser. Where the dispenser is, for example, a pump type dispenser having a single use disposable cartridge mounted to a reusable upper member having the spout, either the cartridge and/or the upper member may include the simulated portion of the mouth anatomy so that the option is provided of having a variety of different anatomical structures whenever a new cartridge is used each of which is of different structure or reusing the same structure when the anatomical structure is incorporated with the reusable upper member. After the toothpaste has been completely dispensed, because of the simulated mouth anatomy, the dispenser could be used as a toy. Where different forms of anatomy are available to the user, the empty dispensers could form collectibles for a user collecting a full or partial series of dispensers.

The upper member thus provides a toothpaste dispenser which includes a hollow container having a chamber with the toothpaste in the chamber and having a dispensing spout communicating with the chamber. The container would have manually operable structure for reducing the size of the chamber to force the toothpaste from the chamber and out of the dispensing spout. Such manually operable movable structure could be by a piston head in a pump or could be by the squeezing of a flexible or semi-flexible (semi-rigid) tube. The spout would have a cap detachably mounted over the spout to selectively open and close the spout. In accordance with the invention externally mounted structure simulating a portion of the human mouth anatomy would be provided on the container in the various manners illustrated and described herein and manners suggested by those descriptions.

What is claimed is:

1. A pump type toothpaste dispenser in the form of a container having a chamber with toothpaste therein, a dispensing spout communicating with said chamber, said container including manually operable movable structure for reducing the size of said chamber to force toothpaste from said chamber and out of said dispensing spout, and a closure detachably mounted over said dispensing spout for selectively opening and closing said dispensing spout, said container comprising a rigid outer barrel and a rigid inner plunger telescopically mounted within said barrel, said barrel and said plunger being longitudinally movable with respect to each other to vary the size of said chamber, one of said barrel and said plunger having externally mounted structure simulating a portion of the human mouth anatomy to function as an indicator for making readily apparent to a user that said dispenser is a dispenser of toothpaste, the other of said barrel and said plunger having an end remote from said structure simulating a portion of the human mouth anatomy, and the distance between said remote end and said structure decreasing after each dispensing of said toothpaste to cause a progressive decrease in the separating distance between said remote end and said structure after each dispensing of said toothpaste.

2. The dispenser of claim 1 wherein said portion of the human mouth anatomy is a tooth.

3. The dispenser of claim 2 wherein said tooth is a molar.

4. The dispenser of claim 1 wherein said portion of the human mouth anatomy is a set of aligned teeth.

5. The dispenser of claim 1 wherein said portion of the human mouth anatomy is a lip.

6. The dispenser of claim 1 wherein said portion of the human mouth anatomy is a tongue.

7. The dispenser of claim 1 wherein said portion of the human mouth anatomy is also said closure.

8. The dispenser of claim 7 wherein said closure is a simulated tooth.

9. The dispenser of claim 1 wherein said portion of the human mouth anatomy is located on said barrel.

10. The dispenser of claim 1 wherein said portion of the human mouth anatomy is located on said plunger.

11. The dispenser of claim 1 wherein said portion of said human anatomy is located on top of and is distinct from said upper member.

12. In a toothpaste dispenser in the form of a container having a chamber with toothpaste therein, a dispensing spout communicating with said chamber, said container including manually operable movable structure for reducing the size of said chamber to force toothpaste from said chamber and out of said dispensing spout, and a closure detachably mounted over said dispensing spout for selectively opening and closing said dispensing spout, the improvement being in that said container includes externally mounted structure simulating a portion of the human mouth anatomy to function as an indicator for making readily apparent to a user that said dispenser is a dispenser of toothpaste, said container being a pump type dispenser having a rigid upper member and a rigid lower member telescopically arranged with respect to each other, said dispensing spout being located at the top of said upper member, and said portion of the human anatomy comprising a first set of simulated structure attached to the lower edge of said upper member and a second set of simulated structure attached to the lower portion of said lower member with said sets of simulated structure being movable toward each other as said toothpaste is dispensed from said container.

13. The dispenser of claim 12 wherein each of said sets of simulated structure comprises a set of aligned teeth.

14. The dispenser of claim 12 wherein said sets of simulated structure comprises lips.

15. In a toothpaste dispenser in the form of a container having a chamber with toothpaste therein, a dispensing spout communicating with said chamber, said container including manually operable movable structure for reducing the size of said chamber to force toothpaste from said chamber and out of said dispensing spout, and a closure detachably mounted over said dispensing spout for selectively opening and closing said dispensing spout, the improvement being in that said container includes externally mounted structure simulating a portion of the human mouth anatomy to function as an indicator for making readily apparent to a user that said dispenser is a dispenser of toothpaste, said portion of the human mouth anatomy being a set of aligned teeth, and said portion of the human anatomy including a second set of aligned teeth with said sets of aligned teeth being movable toward each other during the dispensing of said toothpaste.

16. In a toothpaste dispenser in the form of a container having a chamber with toothpaste therein, a dispensing spout communicating with said chamber, said container including manually operable movable structure for reducing the size of said chamber to force toothpaste from said chamber and out of said dispensing spout, and a closure detachably mounted over said dispensing spout for selectively opening and closing said dispensing spout, the improvement being in that said container includes externally mounted structure simulating a portion of the human mouth anatomy to function as an indicator for making readily apparent to a user that said dispenser is a dispenser of toothpaste, said portion of the human mouth anatomy is a lip, and said portion of the human mouth anatomy including a second lip with said lips being movable toward each other during the dispensing of said toothpaste.

* * * * *